US010415327B2

(12) United States Patent
Hanna et al.

(10) Patent No.: US 10,415,327 B2
(45) Date of Patent: Sep. 17, 2019

(54) POSITIONING ARRANGEMENT, ROD HANDLING DEVICE, DRILL RIG AND METHOD FOR POSITIONING OF A DRILL ROD

(71) Applicant: Atlas Copco Rock Drills AB, Örebro (SE)

(72) Inventors: Jan Hanna, Hässelby (SE); Venugopal Nagaraj, Bangalore (IN)

(73) Assignee: EPIROC ROCK DRILLS AKTIEBOLAG, Örebro (SE)

( * ) Notice: Subject to any disclaimer, the term of this patent is extended or adjusted under 35 U.S.C. 154(b) by 19 days.

(21) Appl. No.: 15/542,889

(22) PCT Filed: Jan. 14, 2016

(86) PCT No.: PCT/SE2016/050016
§ 371 (c)(1),
(2) Date: Jul. 11, 2017

(87) PCT Pub. No.: WO2016/118063
PCT Pub. Date: Jul. 28, 2016

(65) Prior Publication Data

US 2018/0023353 A1 Jan. 25, 2018

(30) Foreign Application Priority Data

Jan. 19, 2015 (SE) ..... 1550039

(51) Int. Cl.
*E21B 19/14* (2006.01)
*E21B 19/16* (2006.01)

(52) U.S. Cl.
CPC ..... *E21B 19/14* (2013.01); *E21B 19/16* (2013.01)

(58) Field of Classification Search
CPC ..... E21B 19/14; E21B 19/16
(Continued)

(56) References Cited

U.S. PATENT DOCUMENTS 6,298,927 B1 * 10/2001 Back ..... E21B 19/14 166/77.51
7,544,036 B1 * 6/2009 Randall ..... E21B 7/20 175/52

(Continued)

FOREIGN PATENT DOCUMENTS

WO 2013116440 A2 8/2013

OTHER PUBLICATIONS

International Search Report of PCT/SE2016/050016, dated Apr. 13, 2016.
Written Opinion of PCT/SE2016/050016, dated Apr. 13, 2016.

*Primary Examiner* — Lynn E Schwenning
(74) *Attorney, Agent, or Firm* — Venable LLP; Jeffri A. Kaminski

(57) ABSTRACT

A positioning arrangement, a rod handling device, a drill rig and a method for positioning a drill rod are provided. The positioning arrangement comprises a positioning organ, arranged to position a drill rod with a length axis, and a displacement arrangement with a first portion and a second portion, the first portion being connected to the positioning organ and the second portion being connectable to a base part. The displacement arrangement is arranged to displace the positioning organ from a first position to a second position via a translational displacement, such that a length axis of a drill rod positioned by the positioning organ will be substantially aligned with the drill hole axis in the second position.

7 Claims, 4 Drawing Sheets

(58) Field of Classification Search
USPC ..... 414/22.51–22.71; 166/77.51, 85.1; 175/52, 85, 122
See application file for complete search history.

(56) References Cited

U.S. PATENT DOCUMENTS

| | | | | |
|---|---|---|---|---|
| 7,712,545 | B2 * | 5/2010 | Voimanen | E21B 7/022 173/141 |
| 9,428,971 | B2 * | 8/2016 | Pyorny | E21B 7/025 |
| 2011/0203820 | A1 | 8/2011 | Marica et al. | |
| 2011/0297446 | A1 * | 12/2011 | Connell | E21B 7/025 175/195 |
| 2013/0302114 | A1 * | 11/2013 | Reddy | E21B 3/02 414/22.55 |
| 2014/0209382 | A1 * | 7/2014 | Smith | E21B 19/20 175/24 |
| 2015/0211310 | A1 * | 7/2015 | Evermark | E21B 19/16 166/250.01 |

* cited by examiner

POSITIONING ARRANGEMENT, ROD HANDLING DEVICE, DRILL RIG AND METHOD FOR POSITIONING OF A DRILL ROD

CROSS-REFERENCES TO RELATED APPLICATIONS

This application is a U.S. National Stage application of PCT/SE2016/050016, filed 14 Jan. 2016 and published on 28 Jul. 2016 as WO 2016/118063, which claims the benefit of Swedish Patent Application No. 1550039-0, filed 19 Jan. 2015, all of which are hereby incorporated by reference in their entireties.

TECHNICAL FIELD

Embodiments herein relate to a positioning arrangement for positioning of a drill rod relatively a drill hole axis. Embodiments herein further relate to a rod handling device comprising a positioning arrangement. Embodiments herein further relate to a drill rig and a method for positioning a drill rod relatively a drill hole axis.

BACKGROUND

During drilling of long bore holes considerable time is used for handling drill string components such as drill rods. Core drilling for exploration purposes are usually performed with rock drilling rigs where drill string components are positioned in an active drill string position with the aid of a winch.

A winch wire is attached to the uppermost part of a drill rod or to a water swivel or hoist plug which in turn is attached to the drill rod. The drill rod is lifted up from a drill rod pile and, via the winch wire, placed onto a part of a feed beam.

Before a drill rod can be attached to a preceding drill rod, the drill rod must be positioned relatively the preceding drill rod such that a respective length axis of the drill rods are substantially aligned. When the drill rods are arranged next to each other such that their respective length axes are substantially aligned, the last drill rod can be attached to the preceding drill rod e.g. via threads.

Positioning and aligning of drill rods is typically cumbersome and time consuming. DE102011112740A1 disclose an arrangement for handling drill rods. The arrangement in DE102011112740A1 can be suitable in some applications but requires a relatively complex cam feeding arrangement. The cam feeding arrangement is configured move the drill rods with a plurality of freedom degrees whereby precision may be reduced. The arrangement in DE102011112740A1 further requires gripping organs which can transfer a momentum to the drill rods when a drill rod is to be aligned with a drill hole axis.

Thus, improvements in the field of positioning arrangements for positioning of drill rods relatively drill hole axes are desirable. There remains a need for a positioning arrangement which can aid an operator to align drill rods in a fast and accurate manner. Furthermore, there remains a need for a reliable positioning arrangement which is easy to handle and economically efficient to produce.

SUMMARY

Embodiments herein aim to provide a positioning arrangement for positioning of a drill rod relatively a drill hole axis, eliminating or at least reducing the problems and/or drawbacks associated with prior art solutions.

According to an embodiment, this is provided by a positioning arrangement for positioning of a drill rod relatively a drill hole axis, the positioning arrangement comprising:

- a positioning organ, arranged to position a drill rod with a length axis, and
- a displacement arrangement with a first portion and a second portion, the first portion being connected to the positioning organ and the second portion being connectable to a base part arranged at a feed beam, wherein the displacement arrangement is arranged to displace the positioning organ from a first position to a second position via a translational displacement, such that a length axis of a drill rod positioned by the positioning organ will be substantially aligned with the drill hole axis in the second position.

Since the displacement arrangement is arranged to displace the positioning organ from a first position to a second position via a translational displacement, such that a length axis of a drill rod positioned by the positioning organ will be substantially aligned with the drill hole axis in the second position, two adjacent drill rods can be attached to each other in a fast and easy manner.

With the translational displacement of the positioning organ, the length axis of the drill rod positioned by the positioning organ will be substantially in parallel with the drill hole axis during the entire displacement procedure. With no rotational displacement of the positioning organ, alignment and attachment of two adjacent drill rods is much facilitated.

When threads of a drill rod is to be screwed into threads of a preceding drill rod, stacking or jamming of the threads is avoided, since the respective length axis of the rods are centralized and in parallel relatively each other in the second position. Thus, with a translational displacement, a risk that directions of two respective length axes of two adjacent drill rods differs slightly from each other is avoided. This risk cannot be entirely avoided with a rotational displacement of the positioning organ.

According to some embodiments the positioning organ is shaped as an elongated tray.

Since the positioning organ is shaped as an elongated tray the positioning organ provides support to a drill rod along a substantial part of its length. With a positioning organ shaped as an elongated tray the drill rod can be positioned and supported solely by the positioning organ. Hereby the drill rod can be displaced in a balanced and controlled manner by a single positioning organ.

With a single positioning organ, a risk that a momentum is transferred between the positioning organ and the drill rod is avoided. Such a risk cannot be avoided when a drill rod is displaced by means of gripping organs since two or more gripping organs which move relatively each other will transfer a momentum to the drill rod.

According to some embodiments the elongated tray has a longitudinal direction which is substantially in parallel with a drill rod length axis when a drill rod is positioned by the positioning organ. Hereby the elongated tray can position and support the drill rod along a substantial part of the length of the drill rod.

According to some embodiments the displacement arrangement is arranged to displace a drill rod in a direction which is substantially perpendicular to the longitudinal direction of the elongated tray. Hereby a length axis of a drill rod positioned by the positioning organ can be substantially aligned with the drill hole axis in an easy and reliable manner.

According to some embodiments the displacement arrangement comprises at least one actuator and two or more links having the first and second portions respectively, the first portions being hinged to the positioning organ and the second portions being arranged to be hinged to the base part.

Since the displacement arrangement comprises at least one actuator and two or more links having the first and second portions respectively, the first portions being hinged to the positioning organ and the second portions being arranged to be hinged to the base part, the translational displacement can be achieved in a reliable and efficient manner.

Thus, hereby is provided a positioning arrangement for positioning of a drill rod relatively a drill hole axis, eliminating or at least reducing the problems and/or drawbacks associated with prior art solutions.

Embodiments herein aim to provide a rod handling device, eliminating or at least reducing the problems and/or drawbacks associated with prior art solutions.

According to an embodiment, this is provided by a rod handling device comprising a rotator device, a feed beam with a linear guide, a base part, slideably arranged to the linear guide, wherein the rod handling device comprises a positioning arrangement according to embodiments described herein, the positioning arrangement being attached to the base part of the rod handling device.

Since the rod handling device comprises a positioning arrangement according to embodiments described herein handling of rods is much facilitated when a drill rod is to be aligned with a drill hole axis and a centre axis of the rotator device.

Furthermore, the combination of a slideable base part and a positioning arrangement configured to displace the positioning organ via a translational displacement has proven to be very efficient for handling of drill rods.

According to some embodiments the feed beam comprises a first feed beam part with a first linear guide part, a second feed beam part with a second linear guide part and a hinge, the second feed beam part being foldable relatively the first feed beam part via the hinge. Hereby a rod handling device that is compact and easy to transport is provided.

Embodiments herein aim to provide a drill rig, eliminating or at least reducing the problems and/or drawbacks associated with prior art solutions.

According to an embodiment, this is provided by a drill rig, wherein the drill rig comprises a positioning arrangement according embodiments described herein. In some embodiments the drill rig comprises a rod handling device according to embodiments described herein.

Embodiments herein aim to provide a method for positioning a drill rod, eliminating or at least reducing the problems and/or drawbacks associated with prior art methods.

According to an embodiment, this is provided by a method for positioning a drill rod relatively a drill hole axis with a positioning arrangement comprising a positioning organ, arranged to position a drill rod with a length axis, and a displacement arrangement with a first portion and a second portion, the first portion being connected to the positioning organ and the second portion being connectable to a base part, wherein the method comprises:

positioning, by the positioning organ, a drill rod with a length axis, displacing, by the displacement arrangement, the positioning organ from a first position to a second position via a translational displacement, such that the length axis of a drill rod becomes substantially aligned with the drill hole axis in the second position Since the method comprises:

positioning, by the positioning organ, a drill rod with a length axis, displacing, by the displacement arrangement, the positioning organ from a first position to a second position via a translational displacement, such that the length axis of a drill rod becomes substantially aligned with the drill hole axis in the second position, both positioning of drill rods and alignment of drill rods relatively each other are much facilitated.

Further features of, and advantages with, the embodiments herein will become apparent when studying the appended claims and the following detailed description.

BRIEF DESCRIPTION OF THE DRAWINGS

The various aspects of embodiments herein, including its particular features and advantages, will be readily understood from the following detailed description and the accompanying drawings, in which.

DETAILED DESCRIPTION

Embodiments herein will now be described more fully with reference to the accompanying drawings. Like numbers refer to like elements throughout. Well-known functions or constructions will not necessarily be described in detail for brevity and/or clarity.

Figure 1:
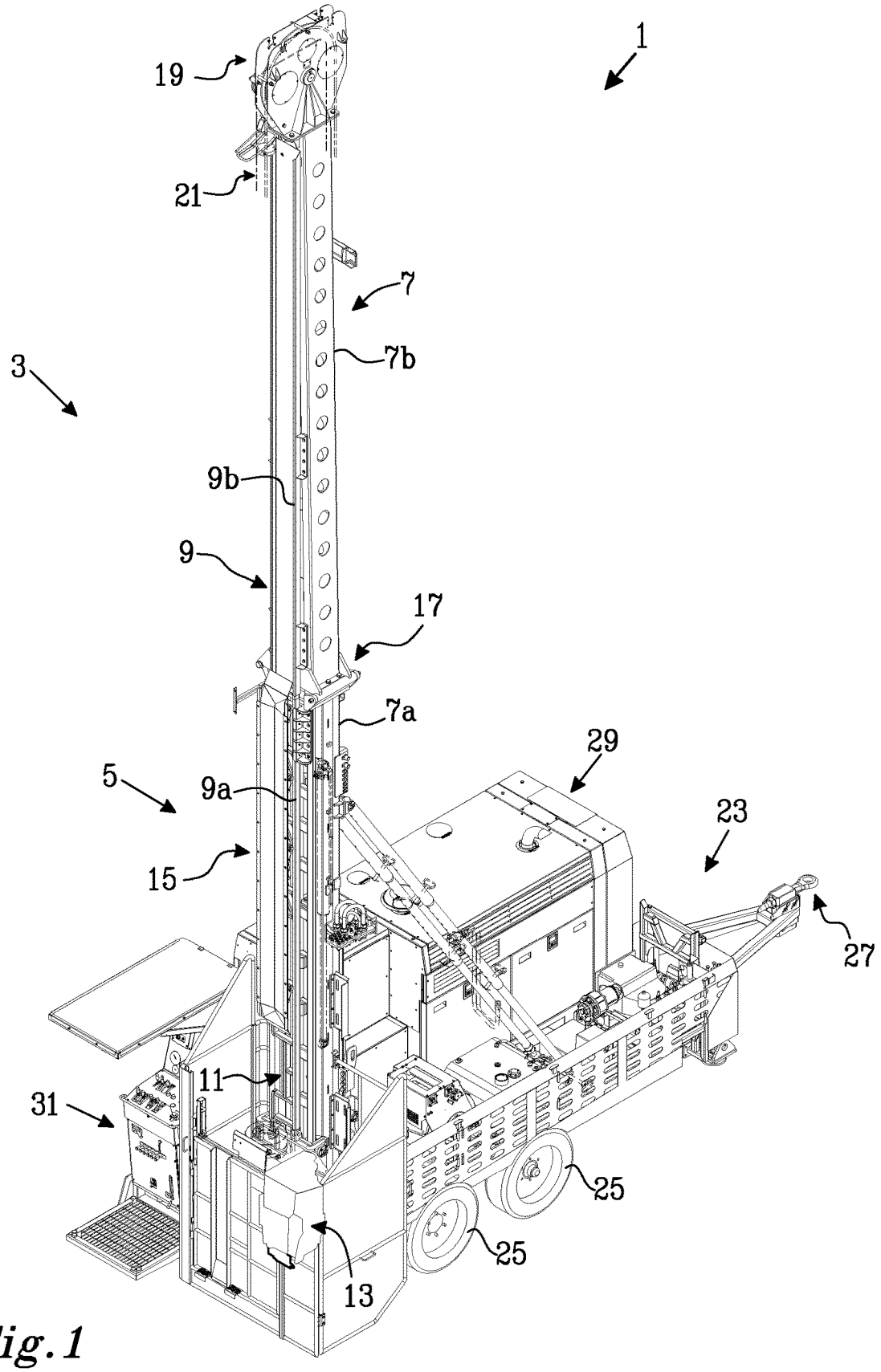
FIG. 1 illustrates a perspective view of a drill rig, a rod handling device and a positioning arrangement according to some embodiments.

FIG. 1 illustrates a drill rig 1, a rod handling device 3 and a positioning arrangement 5 according to some embodiments. The drill rig 1 can also be referred to as a rock drill rig, a surface drill rig, an underground drill rig or an exploration drill rig.

The rod handling device 3 of the drill rig 1 is equipped with a feed beam 7 whereon a linear guide 9 is attached. The linear guide 9 extends along a length of the feed beam 7 and can be provided e.g. as a rail.

A base part 11 supporting a rotator device 13, such as a rock drilling machine, is moveable to and fro along the linear guide 9. The base part 11 can be arranged as a slide, sledge or carrier. The base part 11 can be arranged as a separate part which is arranged to be attached to the feed beam 7 or as a part of the feed beam 7. The base part 11 can slide along the linear guide 9 of the feed beam 7. When mounted, the base part 11 is arranged at the feed beam 7 such that it is movably along the linear guide 9 in the length direction of the feed beam 7 but substantially fixed in a direction perpendicular to the length direction of the feed beam 7. The base part 11 may comprise protrusions, projections, wheels, grooves or other parts that can interact with complementary shaped parts of the linear guide 9. The base part 11 can comprise a number of different components which, when assembled, form the base part 11.

The base part 11 also serves as a base for a displacement arrangement, which is not shown in FIG. 1 but which is denoted 35 in FIGS. 3*a*, 3*b*, 4*a* and 4*b*. In FIG. 1 a positioning organ 15 is illustrated. The positioning organ 15 is also further discussed in conjunction with FIGS. 3, and 4.

The rotator device 13, the displacement arrangement 35 and the positioning organ 15 are thus together moveably arranged on the linear guide 9 via the base part 11.

In the embodiment illustrated in FIG. 1 the feed beam 7 comprises a first feed beam part 7*a* with a first linear guide part 9*a* and a second feed beam part 7*b* with a second linear guide part 9*b*. The second feed beam part 7*b* with the second linear guide part 9*b* is foldable relatively the first feed beam part 7*a* with the first linear guide part 9*a* via a hinge 17. Hereby transport of the drill rig 1 with the feed beam 7 is facilitated. The first feed beam part 7*a* can be fastened to the second feed beam part 7*b* with any suitable fastening means such that a secure attachment between the parts is achieved. For example, the first feed beam part 7*a* can be fastened to the second feed beam part 7*b* with bolts, screws, engaging parts, male/female coupling members, a bayonet coupling, a locking arrangement or similar. In some embodiments the feed beam 7 is a single feed beam, i.e. a feed beam with only one continuous body, The rod handling device 3 comprises the rotator device 13, the feed beam 7 with the linear guide 9 and the base part 11. The rod handling device further comprises a pulley 19, such as a crown block, and a winch wire 21. The winch wire 21 is fastened to a winch in one end and can be attached to a drill rod, a water swivel and/or a hoist plug in the other end. The pulley 19 is arranged to guide and/or suspend the winch wire 21.

The rod handling device 3 is arranged to handle drill string components, such as drill rods. The rod handling device 3 is arranged to successively position the drill rods (not shown in FIG. 1) in a drill string position of the rotator device 13. The rod handling device 3 is also arranged to successively remove drill rods from the drill string position when the drill string/drill rods are taken out from a bore hole (not shown), for example when it is time to replace a drill bit (not shown).

The drill rig 1 illustrated in FIG. 1 does not comprise any magazine for the drill rods. In other embodiments (not shown) the drill rig 1 also comprises a drill rod magazine and an arrangement for transporting the drill rods between the magazine and the rod handling device 3.

In FIG. 1 the drill rig 1 comprises a carrier 23 which can be transported via wheels 25 and a tow-hook arrangement 27. The drill rig 1 is thus transportable by a towing vehicle. In some embodiments (not shown) the drill rig 1 comprises a motor and caterpillar tracks such that the drill rig 1 can re-position itself to a desired drill location.

The drill rig 1 further comprises a power and supply aggregate 29 for providing pressure fluid etc. to the drill rig 1 and a control panel 31 via which an operator can control necessary functions and/or movements of the drill rig 1 and any controllable part or component thereof.

Figure 2:
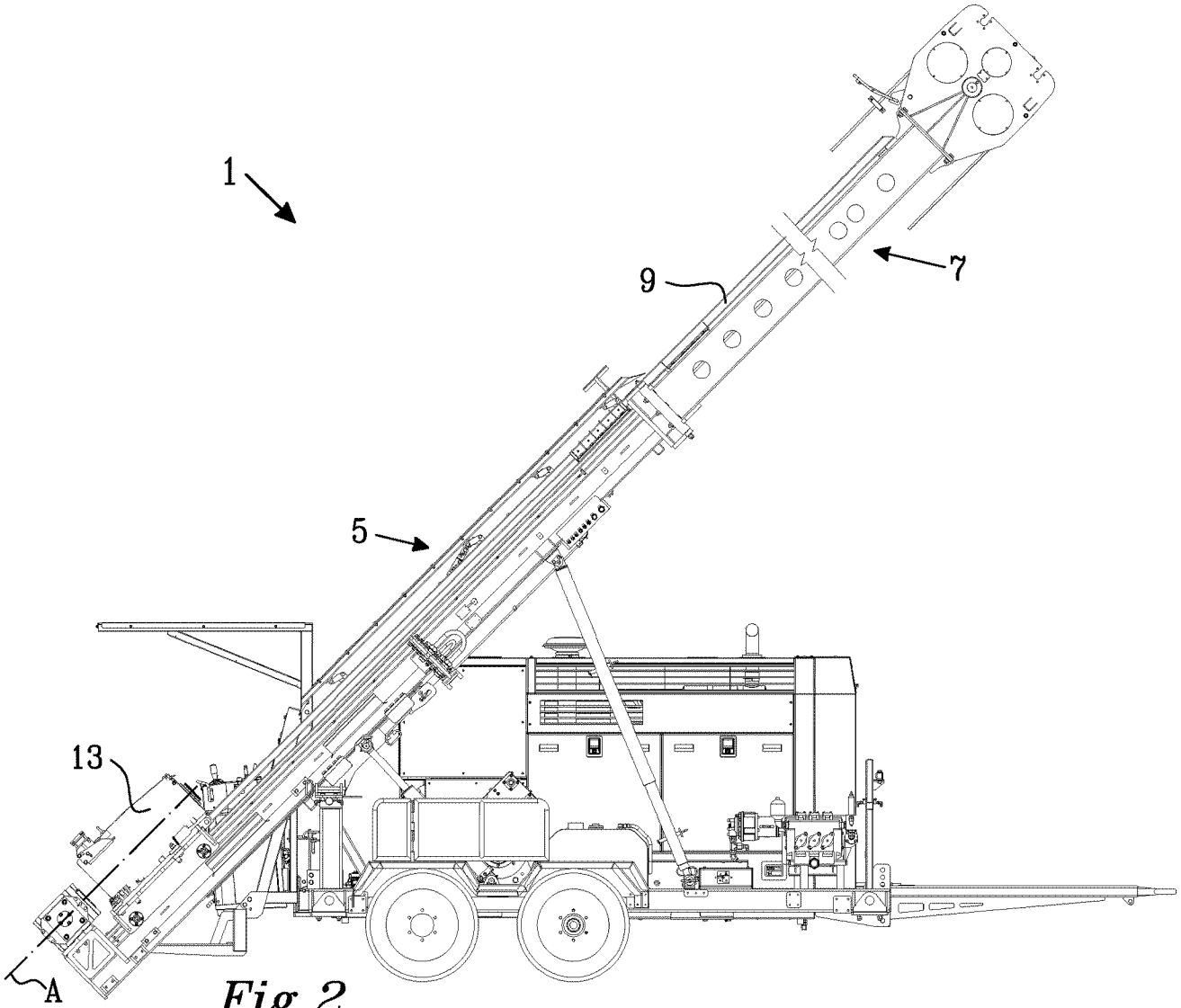
FIG. 2 illustrates a side view of the FIG. 1 drill rig, rod handling device and positioning arrangement.

FIG. 2 illustrates a side view of the drill rig 1 with the rod handling device including the feed beam 7, the linear guide 9 and the positioning arrangement 5. For the sake of clarity a part of the feed beam 7 is cut away.

FIG. 2 further illustrates a drill hole axis A. The drill hole axis A is the centre of a drill hole drilled by the drill rig 1.

As illustrated in FIG. 2, the feed beam 7 and the rod handling device can be tilted relatively the ground surface. In FIG. 2 an angle between the drill hole axis A and the ground surface is approximately 45 degrees, but any angle is possible. The drill rig 1 can thus be used for vertical drilling, for inclined drilling or for horizontal drilling.

Figure 3A:
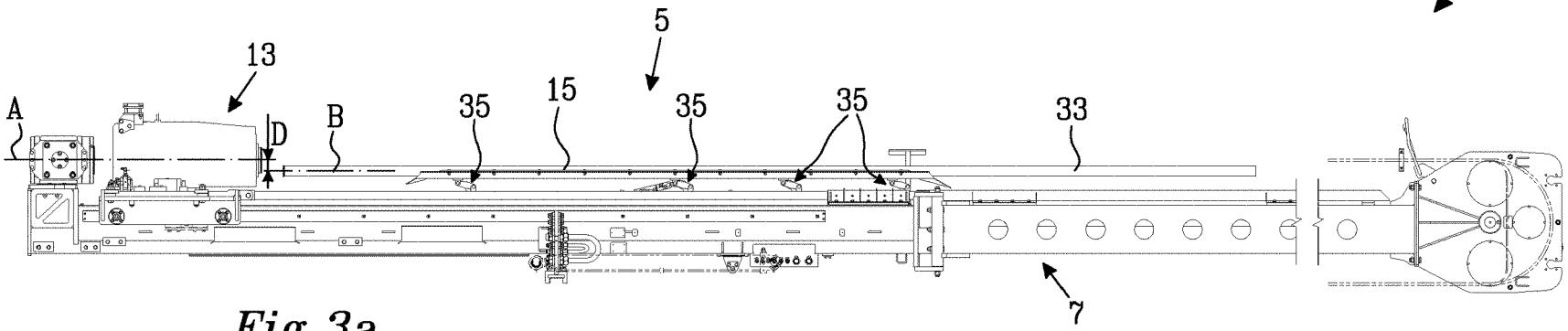
FIG. 3*a* illustrates the rod handling device and the positioning arrangement in the first position.
Figure 3B:
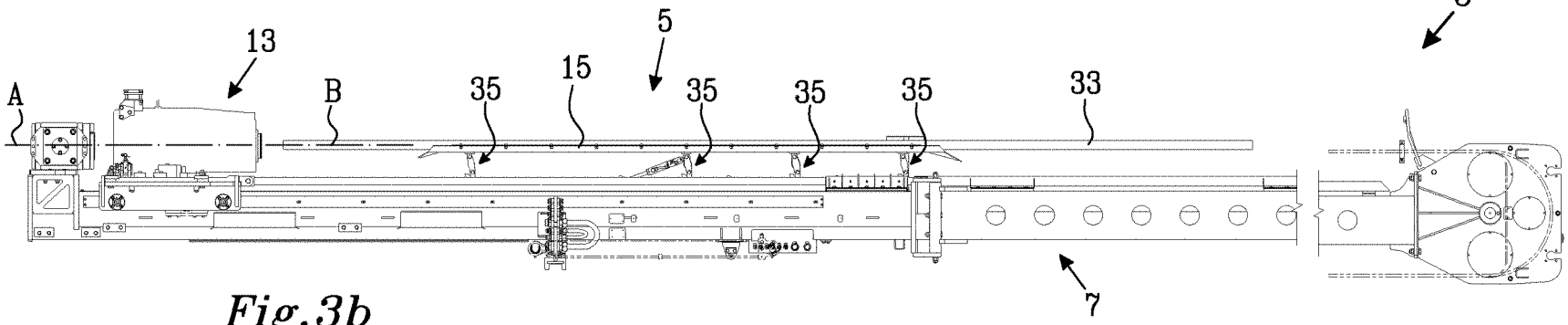
FIG. 3*b* illustrates the rod handling device and the positioning arrangement in the second position.

FIG. 3*a* and FIG. 3*b* illustrate side views of the rod handling device 3. In FIGS. 3*a* and 3*b* the feed beam 7, the positioning arrangement 5 and the rotator device 13 are illustrated. For the sake of clarity a part of the feed beam 7 is cut away. In FIGS. 3*a* and 3*b* a drill string component in form of a drill rod 33 is positioned and/or supported by the positioning organ 15. In FIGS. 3*a* and 3*b* the rod handling device 3 is illustrated as substantially vertically arranged, but as mentioned above the rod handling device 3 is also designed to be tiltable and thus arranged to position and/or support drill string components such as drill rods 33 at any angle.

FIG. 3*a* illustrates the positioning arrangement 5 in a first position. In this first position a drill rod 33 has been placed on the positioning organ 15. Since the positioning organ 15 can be raised and lowered relatively the feed beam 7, the positioning organ 15 can be in an arbitrary position.

As illustrated in FIG. 3*a*, a length axis B of the drill rod 33 is not aligned with the drill hole axis A. In other words, there is a distance D between the length axis B of the drill rod 33 and the drill hole axis A. Distance D extends in a direction which is substantially perpendicular to the length axis B of the drill rod 33 and the drill hole axis A. Since the length axis B of the drill rod 33 and the drill hole axis A are not aligned, or off-set relatively each other, the drill rod 33 cannot be attached to a preceding drill rod arranged within the rotator device 13.

In FIGS. 3*a* and 3*b* a displacement arrangement 35 is illustrated. The displacement arrangement 35 is configured to displace the positioning organ 15 relatively the drill hole axis A and the centre of the rotator device 13 and thus also relatively the feed beam 7.

In FIG. 3*b* the positioning arrangement 5 is illustrated in a second position. I this second position the displacement arrangement 35 has displaced the positioning organ 15 from the first position to the second position via a translational displacement. Hereby the length axis B of the drill rod 33 positioned by the positioning organ 15 is substantially aligned with the drill hole axis A in the second position. The drill hole axis A coincides with a centre axis of the rotator device 13 in the second position. Thus, the displacement arrangement 35 is arranged to displace the positioning organ 15 from a first position to a second position via a translational displacement, such that a length axis B of a drill rod positioned by the positioning organ 15 will be substantially aligned with the centre of the rotator device 13 in the second position.

In this second position the drill rod 33 can be attached to a preceding drill rod (not shown) which is positioned at the centre of the rotator device 13. The displacement arrangement 35 is thus arranged to displace the positioning organ 15 from the first position to the second position via a translational displacement having one degree of freedom only, i.e. along a straight line or axis only.

The displacement arrangement 35 is thus arranged to displace the positioning organ 15 from a first, non-centralized, position to a second, centralized, position via the translational displacement. In the non-centralized position the length axis B of a drill rod positioned by the positioning organ 15 is not aligned with the drill hole axis A/the centre of the rotator device 13. In the centralized position the length axis B of a drill rod positioned by the positioning organ 15 is aligned with the drill hole axis A/the centre of the rotator device 13. When the length axis B of a drill rod positioned by the positioning organ 15 is aligned with the drill hole axis A/the centre of the rotator device 13, the axes substantially coincide.

With "translational displacement" is meant that all parts of the drill rod 33 are displaced the same distance simultaneously. In other words, no rotation of the drill rod 33 occurs.

"Translational displacement" is also referred to as parallel displacement or parallel movement.

Figure 4A:
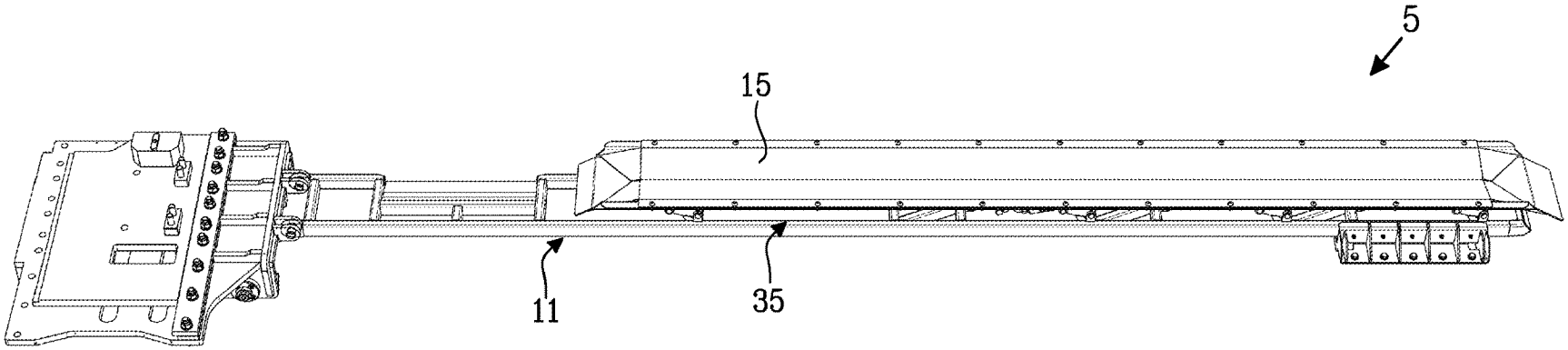
FIG. 4*a* illustrates a perspective view of a base part and the positioning arrangement.
Figure 4B:
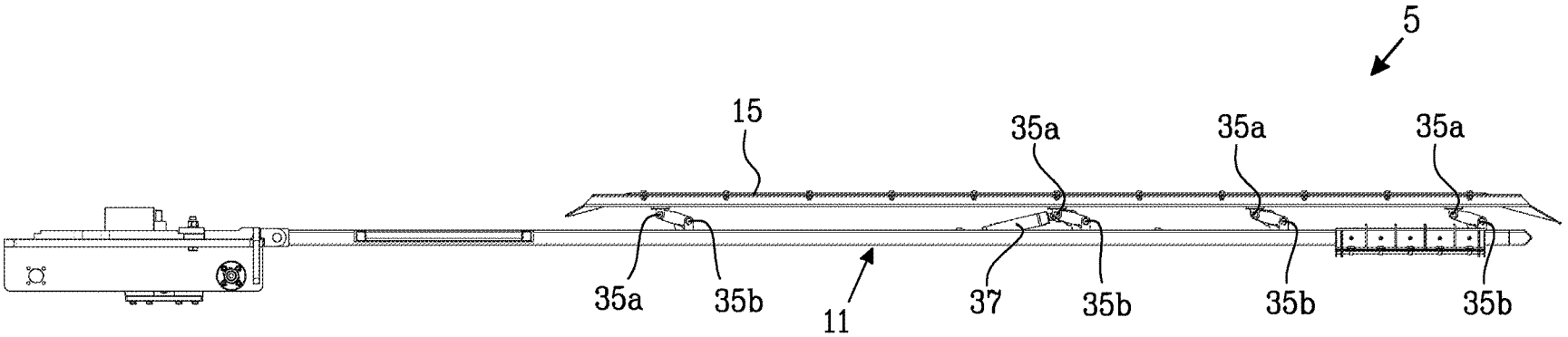
FIG. 4*b* illustrates a side view of the base part and the positioning arrangement.

FIG. 4*a* illustrates the positioning arrangement 5 in perspective and FIG. 4*b* illustrates a side view of the positioning arrangement 5. In the figures the positioning organ 15 and the displacement arrangement 35 are illustrated.

In FIG. 4*a* the positioning organ 15 is shaped as an elongated tray, having a length axis substantially in parallel with a drill rod which is to be positioned and supported by the elongated tray. The length axis of the elongated tray is also substantially in parallel with the feed beam 7 (not shown in FIG. 4*a*). The elongated tray is arranged to continuously be in contact with a drill rod 33 when placed on the elongated tray. A surface of the elongated tray which is arranged towards a drill rod 33 can be concave or V-shaped, such that the drill rod 33 automatically is centred in the elongated tray. The elongated tray may be continuous or may be provided with a number of gaps.

In one embodiment (not shown) the positioning organ 15 comprises a plurality of distinct support points/dimples which together are arranged to position a drill rod 33. The drill rod 33 can then be supported in a plurality of different points by the plurality of distinct support points. For example, 2-5 support points may be used. Alternatively a larger amount of support is used, such as 6-50.

In one embodiment (not shown) the positioning organ 15 comprises a plurality of projecting edges which together are arranged to position a drill rod 33. Such projecting edges may be uniformly or non-uniformly distributed to position/support a drill rod 33. Such edges may be straight or have a V-shape or U-shape, thereby being arranged to position a drill rod 33 in more than one radial direction.

In one embodiment (not shown) the positioning organ 15 is shaped as a ladder. A ladder-shaped positioning organ 15 can support a drill rod 33 via rungs of the ladder and/or via elongated supports of the ladder.

In one embodiment (not shown) the positioning organ 15 is shaped as one or more gripping organs. In one embodiment (not shown) the positioning organ 15 is shaped as a mesh.

In some embodiments a length of the positioning organ 15 is dimensioned to position and support a drill rod 33 along a substantial part of its length. The positioning organ 15 can thus for example be at least 1 meter, at least 2 meters or at least 3 meters. The positioning organ 15 can be arranged to support drill rods 33 of any length, for instance with a length of 3-9 meters. Thus, the positioning organ 15 can be arranged to support drill rods 33 along at least 50% of the drill rod 33 length. In some embodiments the positioning organ 15 is arranged to support drill rods 33 along at least 30%, 40%, 50%, 60% or 70% of its length. Hereby drill rods 33 of different lengths can be positioned and supported in a balanced manner. A width of the positioning organ 15 can be e.g. 5-40 cm such that drill rods of different diameter can be positioned and supported.

The displacement arrangement 35 comprises at least one first portion 35*a* and at least one second portion 35*b*. In the embodiment illustrated in FIG. 4*b* the displacement arrangement 35 comprises four first portions 35*a* and four second portions 35*b* but in other embodiments the displacement arrangement 35 comprises e.g. one, two, three, five or six first and second portions 35*a*, 35*b*.

The first portion 35*a* is connected to the positioning organ 15 and the second portion 35*b* is connected to the base part 11.

In the FIG. 4*b* embodiment the displacement arrangement 35 comprises at least one actuator 37 and four links having the first 35*a* and second 35*b* portions respectively. The first portions 35*a* are hinged to the positioning organ 15 and the second portions 35*b* are hinged to the base part 11.

In other, not illustrated embodiments, the displacement arrangement 35 is configured to displace the positioning organ 15 with other arrangements than a link arrangement. The displacement arrangement 35 can then comprise one or more hydraulic or pneumatic cylinders, gear racks, electrical actuators, lever arms or similar arranged between the base part 11 and the positioning organ 15.

On the left part of base part 11, as shown in FIGS. 4*a* and 4*b*, the previously discussed rotator device 13 is arranged to be mounted, as seen in FIGS. 3*a* and 3*b*.

Figure 5:
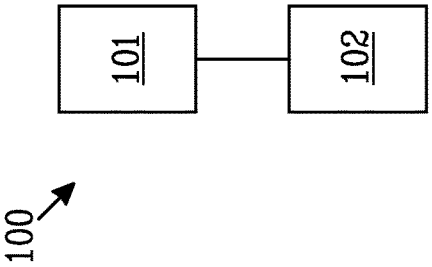
FIG. 5 illustrates a method for positioning a drill rod relatively a drill hole axis.

FIG. 5 illustrates a method 100 for positioning a drill rod 33 relatively a drill hole axis A with a positioning arrangement 5 comprising a positioning organ 15, arranged to position a drill rod 33 with a length axis B, and a displacement arrangement 35 with a first portion 35*a* and a second portion 35*b*, the first portion 35*a* being connected to the positioning organ 15 and the second portion 35*b* being connectable to a base part 11.

The method 100 comprises:

positioning 101, by the positioning organ 15, a drill rod 33 with a length axis B, displacing 102, by the displacement arrangement 35, the positioning organ 15 from a first position to a second position via a translational displacement, such that the length axis B of a drill rod 33 becomes substantially aligned with the drill hole axis A in the second position.

As used herein, the term "comprising" or "comprises" is open-ended, and includes one or more stated features, elements, steps, components or functions but does not preclude the presence or addition of one or more other features, elements, steps, components, functions or groups thereof.

The invention claimed is:

1. A positioning arrangement for positioning of a drill rod relatively a drill hole axis, the positioning arrangement comprising:

a positioning organ, arranged to position a drill rod with a length axis, and a displacement arrangement with a first portion and a second portion, the first portion being connected to the positioning organ and the second portion being connectable to a base part arranged to be attached to a feed beam, wherein the displacement arrangement is arranged to displace the positioning organ from a first position to a second position via a translational displacement, such that a length axis of a drill rod positioned by the positioning organ will be substantially aligned with the drill hole axis in the second position and wherein the positioning organ is shaped as an elongated tray, and wherein the displacement arrangement is arranged to displace a drill rod in a direction which is substantially perpendicular to the longitudinal direction of the elongated tray.

2. The positioning arrangement according to claim 1, wherein the elongated tray has a longitudinal direction which is substantially in parallel with a drill rod length axis when a drill rod is positioned by the positioning organ.

3. The positioning arrangement according to claim 1, wherein the displacement arrangement comprises at least one actuator and two or more links having the first and second portions respectively, the first portions being hinged to the positioning organ and the second portions being arranged to be hinged to the base part.

4. Rod handling device comprising:

a rotator device, a feed beam with a linear guide, a base part, slideably arranged to the linear guide, wherein the rod handling device comprises a positioning arrangement, the positioning arrangement being attached to the base part, the positioning arrangement comprising:

a positioning organ, arranged to position a drill rod with a length axis, and a displacement arrangement with a first portion and a second portion, the first portion being connected to the positioning organ and the second portion being connectable to a base part arranged to be attached to a feed beam, wherein the displacement arrangement is arranged to displace the positioning organ from a first position to a second position via a translational displacement, such that a length axis of a drill rod positioned by the positioning organ will be substantially aligned with the drill hole axis in the second position and wherein the positioning organ is shaped as an elongated tray, and wherein the displacement arrangement is arranged to displace a drill rod in a direction which is substantially perpendicular to the longitudinal direction of the elongated tray.

5. Rod handling device according to claim 4, wherein the feed beam comprises a first feed beam part with a first linear guide part, a second feed beam part with a second linear guide part and a hinge, the second feed beam part being foldable relatively the first feed beam part via the hinge.

6. Drill rig, wherein the drill rig comprises:

a carrier; and a positioning arrangement, the positioning arrangement comprising:

a positioning organ, arranged to position a drill rod with a length axis, and a displacement arrangement with a first portion and a second portion, the first portion being connected to the positioning organ and the second portion being connectable to a base part arranged to be attached to a feed beam, wherein the displacement arrangement is arranged to displace the positioning organ from a first position to a second position via a translational displacement, such that a length axis of a drill rod positioned by the positioning organ will be substantially aligned with the drill hole axis in the second position and wherein the positioning organ is shaped as an elongated tray, and wherein the displacement arrangement is arranged to displace a drill rod in a direction which is substantially perpendicular to the longitudinal direction of the elongated tray.

7. Method for positioning a drill rod relatively a drill hole axis with a positioning arrangement comprising a positioning organ, arranged to position a drill rod with a length axis, and a displacement arrangement with a first portion and a second portion, the first portion being connected to the positioning organ and the second portion being connectable to a base part, wherein the method comprises:

positioning, by the positioning organ, shaped as an elongated tray, a drill rod with a length axis, displacing, by the displacement arrangement, the positioning organ from a first position to a second position via a translational displacement, such that the length axis of a drill rod becomes substantially aligned with the drill hole axis in the second position, and the drill rod is displaced in a direction which is substantially perpendicular to the longitudinal direction of the elongated tray.

* * * * *